US006209650B1

(12) United States Patent
Ingebrigtsen et al.

(10) Patent No.: US 6,209,650 B1
(45) **Date of Patent: *Apr. 3, 2001**

(54) SUBSEA WELL

(75) Inventors: Atle Ingebrigtsen, Nesttun; Jørgen Eide, Stend, both of (NO)

(73) Assignee: Den Norske Stats Oljeselskap AS, Stavanger (NO)

( * ) Notice: Subject to any disclaimer, the term of this patent is extended or adjusted under 35 U.S.C. 154(b) by 0 days.

This patent is subject to a terminal disclaimer.

(21) Appl. No.: 09/242,958

(22) PCT Filed: Aug. 21, 1997

(86) PCT No.: PCT/NO97/00218

§ 371 Date: Feb. 26, 1999

§ 102(e) Date: Feb. 26, 1999

(87) PCT Pub. No.: WO98/09050

PCT Pub. Date: Mar. 5, 1998

(30) Foreign Application Priority Data

Aug. 27, 1996 (NO) ..... 963585

(51) Int. Cl.[7] ..... E21B 33/038
(52) U.S. Cl. ..... 166/368; 166/345; 166/355
(58) Field of Search ..... 166/341, 345, 166/346, 347, 351, 352, 353, 354, 355, 368, 366

(56) References Cited

U.S. PATENT DOCUMENTS

| | | | | |
|---|---|---|---|---|
| 3,750,749 | | 8/1973 | Giroux | 166/95 |
| 4,326,312 | | 4/1982 | Tang | 441/5 |
| 4,668,126 | * | 5/1987 | Burton | 166/345 |
| 5,148,871 | * | 9/1992 | Gullion | 166/355 |
| 5,288,253 | * | 2/1994 | Usrdshals et al. | 166/355 |

FOREIGN PATENT DOCUMENTS

| | | |
|---|---|---|
| 2 656 274 | 6/1991 | (FR) . |
| 1 549 766 | 8/1979 | (GB) . |
| 2 273 087 | 8/1994 | (GB) . |
| 2 168 939 | 7/1996 | (GB) . |
| 87 1005 | 10/1988 | (NO) . |
| 177780 | 8/1995 | (NO) . |
| WO 95/01904 | 1/1995 | (WO) . |
| WO95/02146 | 1/1995 | (WO) . |

* cited by examiner

*Primary Examiner*—David Bagnell
*Assistant Examiner*—Frederick L. Lagman
(74) *Attorney, Agent, or Firm*—Foley & Lardner

(57) ABSTRACT

Subsea well arrangement for offshore production of oil or gas, comprising a wellhead, a christmas tree mounted on the wellhead and at least one riser for connection with a production vessel at the sea surface. At the top of the christmas tree there is provided a swivel device communicating with the christmas tree, and the swivel device is provided with preferably laterally directed connecting members for risers or hoses and for an umbilical or control cable.

11 Claims, 3 Drawing Sheets

SUBSEA WELL

FIELD OF INVENTION

This invention relates to a subsea well arrangement for offshore production of oil or gas, comprising a wellhead, a christmas tree mounted on the wellhead and at least one riser for connection with a production vessel at the sea surface.

BACKGROUND OF THE INVENTION

When developing marginal offshore production fields it is important to keep the costs low. A substantial cost factor with known forms of development, is due to subsea pipelines and cables between christmas trees at the wells and product receiver sites, for example a platform or a floating production vessel. Typically there may here be the question of distances like 2 km. In this connection it is to be noted that modern drilling technology makes it possible to produce by means of a reduced number of christmas trees, because the boreholes or wells can have several branches. This will make it possible to develop subsea fields in some instances by employing only one subsea christmas tree.

International patent application PC/NO96/00201 dated Jul. 8, 1996 relates to a system for offshore production of hydrocarbons by employing a moored production vessel or ship. The present invention can be regarded as a further development thereof and is based on the idea that the production vessel can by lying directly above or in the immediate vicinity of the christmas tree at the seabed and that the well fluid flows are transferred directly between the christmas tree and the vessel without relying on pipelines or cables on the seabed. In this connection the invention is not exclusively based upon location of the production vessel by means of mooring, as according to the international patent application mentioned above, but can also employ means as known per se for dynamic positioning of the vessel.

BRIEF SUMMARY OF THE INVENTION

The solution to be described in the following specification can either be utilized in production from an existing or already installed and also conventional christmas tree at the seabed, or by employing a particular and preferably simplified form of christmas tree, being more or less integrated into an arrangement according to the invention, as will appear from the following description.

In an arrangement as stated in the introduction above, the novel and specific features according to the invention primarily comprise that on top of the christmas tree there is provided a swivel device communicating with the christmas tree and that the swivel device is provided with preferably laterally directed connection members for risers or hoses and for an umbilical or control cable.

On the basis of this fundamental solution, which in actual practice can be embodied in various forms, it is possible to obtain a number of advantages, of which in particular the following are mentioned:

- The production vessel employed does not need any modifications worth mentioning, in relation to common ship designs, and therefore will be relatively inexpensive,
- the same production vessel can be used for installing and possibly retrieve the swivel device, or also for well maintenance, which contributes to reduced operational costs,
- very small marginal subsea fields can be profitable by using this novel arrangement, so that the degree of extraction can be increased for the fields,
- the equipment employed can be re-used by moving it from field to field.

A preferred embodiment of the present invention comprises a subsea well arrangement for offshore production of oil or gas, comprising a base structure having its foundation on a seabed, a housing rotatably mounted about a first central, vertical axis on the base structure, a wellhead, a christmas tree mounted on the wellhead, at least one riser for connection to a production vessel at sea surface, a swivel device provided over the christmas tree, the swivel device communicating with the christmas tree and the swivel device being rotatable about the first, central vertical axis, at least one connecting member provided on the swivel device for connection with the at least one riser or hoses and with an umbilical or control cable, at least one attachment member provided on the housing, a yoke rotatable within a first angle about a horizontal axis and connected to the at least one attachment member, the yoke adapted to be connected at its outer end to at least one mooring line of the production vessel and wherein the housing rotatably mounted on the base structure having its foundation on the seabed is adapted to transfer mooring forces directly from the attachment members to the foundation without any noticeable stress applied to the christmas tree or the swivel device.

In one aspect of the preferred embodiment, the yoke contains yoke legs connected to attachment members and a lower end of the at least one riser is connected centrally to the swivel device and extends outwards from the swivel device centrally between the yoke legs.

In another aspect of the preferred embodiment, the connecting member for the umbilical cable is located at an upper part of said swivel device, and the swivel device contains a swivel member for cable connections at the same level as the connecting member for the umbilical cable.

BRIEF DESCRIPTION OF THE DRAWINGS

In the following description the invention will be explained more closely with referance to the drawings, in which.

DETAILED DESCRIPTION OF THE INVENTION

Figure 1:
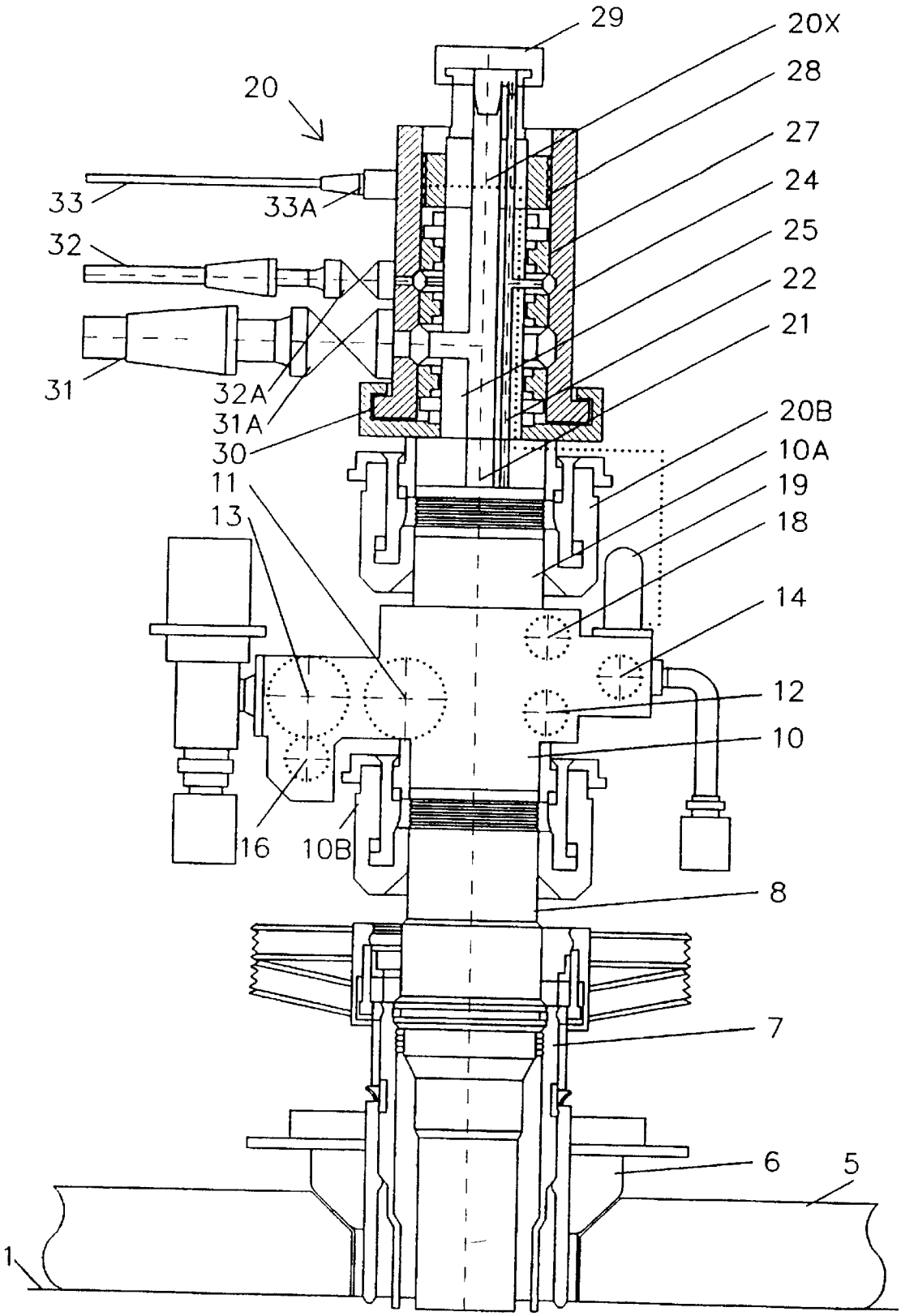
FIG. 1 shows an example of an embodiment of the arrangement according to the invention, as seen in elevation and partially in section, base on a conventional well completion with a common christmas tree, FIG. 2 in a corresponding way shows an embodiment according to the invention, wherein there is employed a christmas tree being specifically adapted in the arrangement, and based on mooring of a production vessel in this arrangement at the seabed.
Figure 2:
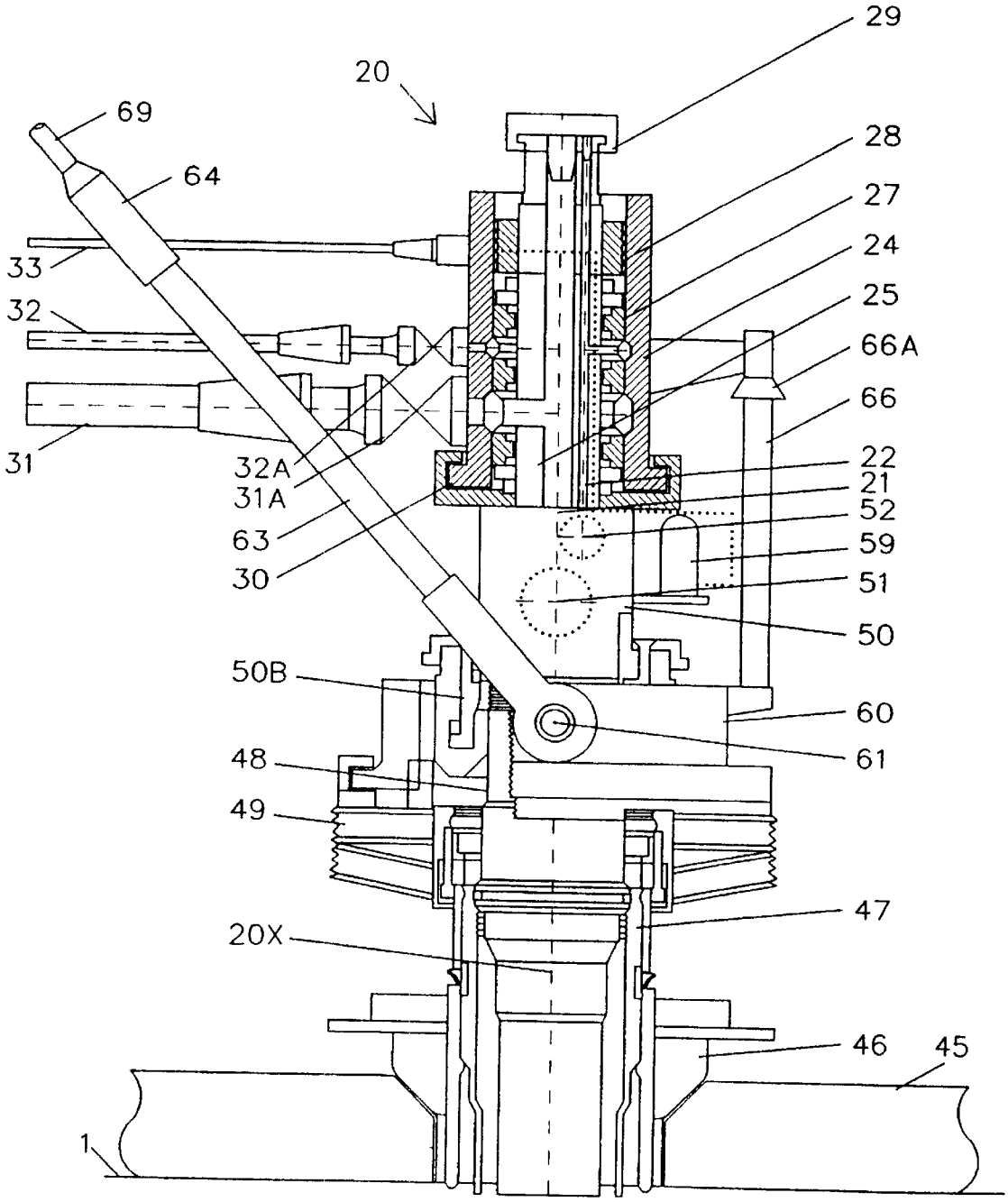
Figure 3:
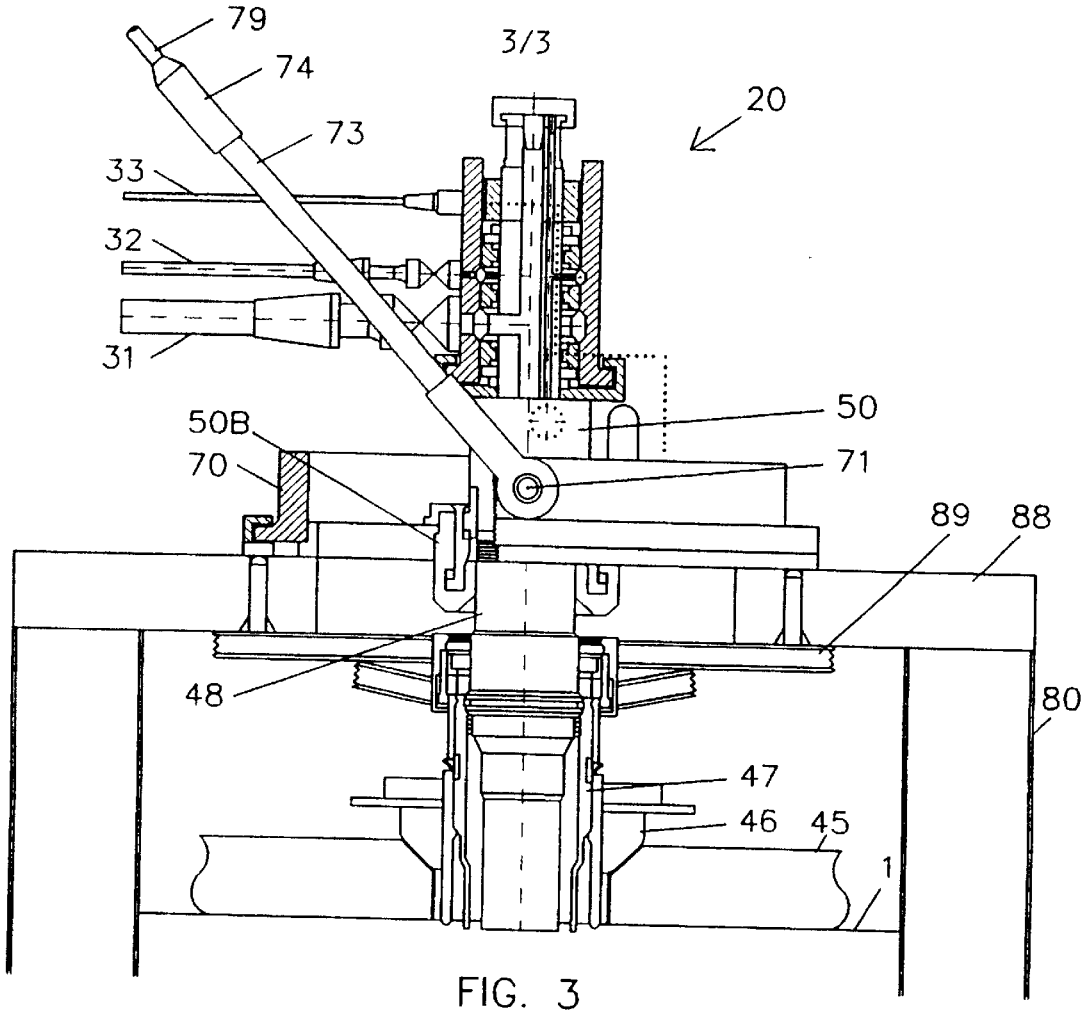
FIG. 3 shows a modification of the solution according to FIG. 2, in which there is incorporated a suction anchor contributing to the foundation of the arrangement.

In FIGS. 1, 2 and 3 there is indicated with hatching those parts and components in the respective arrangements, which take part in the swing or turning movements when a production vessel moves around a subsea wellhead under the influence of wind and weather and other conditions at the sea surface, in particular waves. As shown in FIGS. 1, 2 and 3 the arrangement is preferably built up with a central and common vertical axis 20X, coinciding with the axis of the wellhead 8 in FIG. 1 and wellhead 48 in FIGS. 2 and 3, i.e. the top of the production tubing.

The embodiment of the arrangement according to the invention shown as an example in FIG. 1, takes as a starting point the situation that it is desired to install equipment at the seabed for direct production from a well to a surface vessel, based on the existence of an already installed christmas tree at the wellhead. In short this embodiment involves the mounting of a swivel device directly on top of the christmas tree, which does not need any modification at all, or which possibly can be altered with a minimum number of modifications. In this case the production vessel at the surface can suitably be maintained in position by means of dynamic positioning in a manner known per se, preferably including means for emergency closing of the well and quick disconnection if the tension in the risers or hoses employed, gets too high, for example when the dynamic positioning system fails or in too strong wind or too large waves.

FIG. 1 in relatively much detail primarily shows more or less common structures at the top of an oil or gas well at the seabed 1. A concrete plate or base 5 forms a foundation on seabed 1 and has a central opening for supporting a self-adjusting ball joint type frame 6 which in turn is connected to a common conductor tube 7. In a known manner this can extend for several tens of meters down into the structure underneath the seabed 1. Within conductor tube 7 the actual production tubing is hanging, and ending at the top in the wellhead 8 itself.

On wellhead 8 there is mounted a christmas tree as known per se, having a main part in the form of a valve block 10. In the valve block there can be provided a number of valves in the usual way, namely the following as shown in FIG. 1: A production master valve 11, an annulus master valve 12, a production wing valve 13, an annulus wing valve 14, a crossover valve 16 and a maintenance valve 18. Besides there is shown a control module 19 for control and checking functions in the christmas tree.

In its lower part christmas tree 10 has connector or coupling means 10B for preferably detachable mounting on wellhead 8, as known per se. Moreover at the top christmas tree 10 has a connector member 10A which can be similar to the upper end of wellhead 8, and being adapted to cooperate with connector means 20B at the bottom of a swivel device 20 to be explained more in detail in the following description.

With detachable connector or connecting means cooperating in this manner, it will be realized that christmas tree 10 and swivel device 20 can be disassembled and retrieved to the surface in common or separately, for the purpose of replacement or maintenance operations. Moreover it is seen that christmas tree 10 and the complete arrangement in which it is incorporated, is carried and supported mainly by the conductor tube 7, but also with a contribution from the concrete foundation plate 5.

Swivel device 20 has a stationary, central core member 25 with axial through bores, comprising a production bore 21 and an annalus bore 22. Both of these communicate downwards with corresponding fluid passages in valve block 10, for the purpose, inter alia, of the various valve functions made possible thereby. Furthermore swivel device 20 around its core member 25 has two or more annular fluid passages with associated sealings and bearing elements, as generally shown at 27. These parts of a fluid swivel are previously known per se, e.g. from Norwegian patent 177.780, which shows an axially separable swivel device, primarily intended for other applications.

Swivel 20 is provided with connecting members generally indicated at 31A and 32A for risers or hoses 31 and 32 adapted to extend upwards through the water to the production vessel. (See FIG. 4). Whereas connecting members 31A and 32A for fluid transfer are located relatively centrally on swivel 20 and directed laterally, an upper connecting member 33A for an umbilical 33 is located at an upper portion of swivel 20, or more definitely at a swivel housing 24 being adapted to rotate about axis 20X during the turning movements mentioned above. A bearing 30 carries the swivel housing 24 and thereby the whole swivel device 20, so that the whole assembly can rotate in relation to the connector means 20B being mounted at the top of christmas tree 10.

The connecting members 31A and 32A mentioned above, can comprise closing valves as indicated in FIG. 1. Fluid passages or bores 21 and 22 in this particular swivel embodiment are extended all the way up to the top of core member 25, which here projects above housing 24, so that from the top of the swivel device 20 it will be possible to have access through these bores and further through valve block 10 down into the valve, in order that it will be possible to carry out operations therein, from the top of swivel device 20. During regular operation these upper openings of bores 21 and 22 are blocked by a plug member 29 or the like.

A particular swivel part 28 at the level of connecting member 33A serves for necessary electric and hydraulic communication for control purposes and the like, between the umbilical 33 and inter alia, the aforementioned control module 19 at christmas tree 10. A dotted line chematically shows this communication path through swivel device 20 and partly at the outside of the christmas tree.

Whereas the examplary embodiment of FIG. 1 in the first place is intended for cooperation with a production vessel being maintained in location by means of dynamic positioning, the embodiments of FIGS. 2 and 3 are based on mooring of the vessel by means of one or more lines to the wellhead arrangement at the seabed. In these two embodiments the subsea installation or arrangement is designed specifically for incorporating a swivel device. The mooring forces, which are much higher than those being exerted by the risers or hoses and possibly the umbilical, in these embodiments are taken up by a structure being not in direct connection with the actual christmas tree assembly. Accordingly, the christmas tree itself, the swivel device or the actual wellhead will not to any degree worth mentioning, be subjected to stresses due to the mooring of the vessel.

In the embodiment of FIG. 2 there is again a foundation plate 45 and a ball joint type frame 46 as well as a conductor tube 47 quite corresponding to what is shown in FIG. 1. Besides in FIG. 2 there is indicated a base structure 49 for supporting the whole arrangement above it. Through strong, supporting structure elements the base structure 49 is directly connected to the conductor tube 47 for transferring mooring forces thereto. Journalled at the base structure 49 there is shown a strong, carousel-like housing 60 being rotatable about the central axis 20X. Housing 60 is provided with preferably diametrically opposed attachment members 61 in the form of projecting studs for a yoke 63, the upper end 64 of which is adapted to be connected to one or more mooring lines 69. It will be seen that yoke 63 has two legs being united at an upper end or cross piece 64. Yoke 63 can assume various angular positions by swinging about the horizontal axis extending diametrically between the attachment members 61, whereby the angular range of the yoke movement at least extends upwards to an approximate vertical position, whereas the lowermost angular position in practice is restricted in view of umbilical 33 and/or risers 31 and 32.

During operation with a moored production vessel, this through the intermediary of line or lines 69 and thereby yoke 63, will cause rotation of the hatched parts of the arrangement about the axis 20X. A corresponding rotary movement takes place in the actual swivel device, whereby the central core member 25 is stationary together with valve block 50, whereas the remaining parts of the swivel including the swivel housing 24 participate in the rotary movement.

In order to secure a simultaneous and common rotary movement of housing 60 and swivel device 20, there is shown a mechanical joint or coupling 66 in the form of an upright rod cooperating at its ends with radial arms connected to housing 60 and swivel housing 24, respectively, as indicated somewhat schematically in FIG. 2. This coupling device 66 can also be utilized during installation and landing of parts of the arrangement, on housing 60 or valve block 50. For this purpose a connecting sleeve at the swivel housing arm can be provided with a downward cone 66A into which the upper end of rod 66 will enter during landing.

As will appear from FIG. 2 and reference numerals 20–30, the actual swivel device 20 in the principle is the same as shown and explained in connection with FIG. 1. It should be noted however, that in FIG. 2 the risers 31 and 32 as well as the umbilical 33 extend laterally outwards preferably centrally between the two yoke legs 63. Moreover in this connection it is preferred that risers 31 and 32 as well as a possible umbilical 33 during all operative conditions and varying vessel positions as well as mooring forces, extend out from the swivel device 20 at a more horizontal angular position than the angular position of the yoke legs 63.

In the more integrated or tailor-made embodiment shown in FIG. 2, there is with advantage employed a simplified christmas tree based on valve block 50, being here shown as comprising only two valves, namely a production master valve 51 and an annalus master valve 52. If required there can be more than two valves. The christmas tree also comprises a control module 59.

The embodiment of the arrangement according to the invention being illustrated in FIG. 3, has very much in common with the one in FIG. 2, except for the addition of a suction anchor 80. The actual swivel device 20 has been shown here in somewhat less detail, but risers/hoses/cables 31/32/33 are present here as in the preceeding embodiments. Likewise the christmas tree 50 can be of the same design as in FIG. 2. The same applies to the yoke 73 with end piece 74 connected to a mooring line or cable 79, whereby the yoke at the lower ends of the legs is connected to attachment members 71 on a rotatable housing 70. This has here a relatively larger diameter than housing 60 in FIG. 2, in particular in view of the transfer of the mooring forces to the suction anchor 80. Suction anchor 80 has a top plate or frame 88 on which the housing 70 is rotatably supported. At its underside the frame 88 is connected to a base structure 89 being incorporated into the structure around the wellhead, in a similar way as the structure according to FIG. 2. Thus the supporting frame 88 has its independent foundation on seabed 1 by means of suction anchor 80, which can also be replaced by other forms of anchor means. In this manner mooring forces from line 79 will be transferred through yoke 73 and attachment members 71 directly to the anchor means 80, without the christmas tree 50, swivel device 20 or the wellhead components 45–48 being to any noticeable degree subjected to large stresses.

Figure 4:
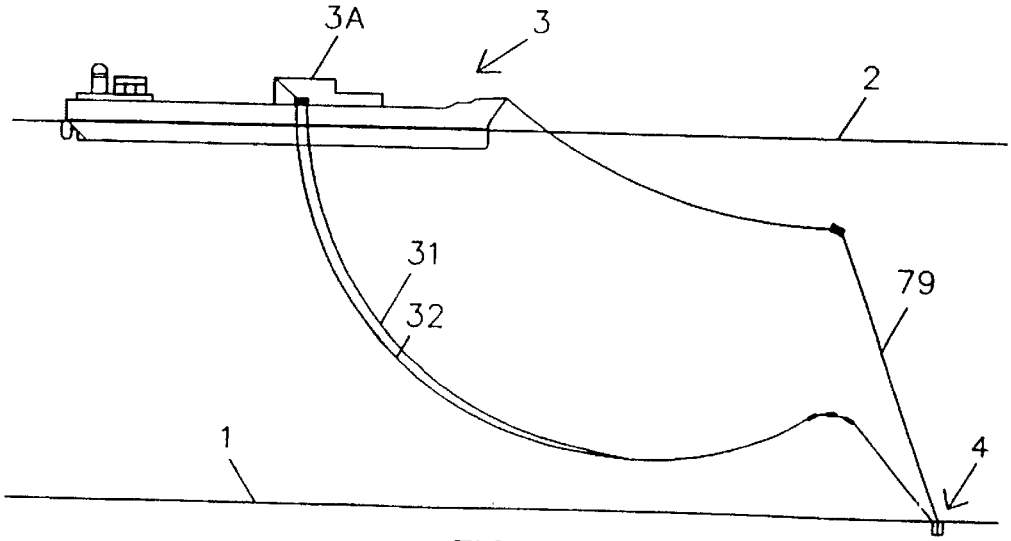
FIG. 4 shows a simplified overview of a total system with a production vessel associated with an arrangement at the seabed and being moored in the principle corresponding to the embodiments of FIGS. 2 and 3.

Finally FIG. 4 shows an overview of the total system when a production vessel or ship 3 operates in association with a well with a wellhead as generally shown at 4 on the seabed 1. The previously mentioned risers or hoses 31 and 32 are shown here in their full length up to the ship 3, where they are connected to a processing unit 3A being shown purely schematically. Moreover the mooring line 79 is shown as a whole, i.e. as extending up through the sea surface 2 to mooring means at the bow portion of the ship 3. An intermediate region of the mooring line 79 is provided with a buoyancy element and likewise the risers 31 and 32 have buoyancy bodies at a lower portion for elevating the risers or hoses from the bottom 1. This general system is described more closely in the above mentioned International patent application.

What is claimed is:

1. A subsea well arrangement for offshore production of oil or gas, comprising:

a base structure having its foundation on a seabed;

a housing rotatably mounted about a first central, vertical axis on the base structure;

a wellhead;

a christmas tree mounted on the wellhead;

at least one riser for connection to a production vessel at sea surface;

a swivel device provided over the christmas tree, the swivel device communicating with said christmas tree and the swivel device being rotatable about the first, central vertical axis;

at least one connecting member provided on the swivel device for connection with the at least one riser or hoses and another connecting member provided on the swivel device for connection with an umbilical or control cable;

at least one attachment member provided on the housing;

a yoke rotatable within a first angle about a horizontal axis and connected to the at least one attachment member, the yoke adapted to be connected at its outer end to at least one mooring line of the production vessel;

wherein the housing rotatably mounted on the base structure having its foundation on the seabed is adapted to transfer mooring forces directly from said at least one attachment member to said foundation without any noticeable stress applied to the christmas tree or the swivel device.

2. The arrangement according to claim 1, wherein:

the wellhead comprises a conductor tube; and said base structure is rigidly connected to the conductor tube, which thus constitutes said foundation.

3. The arrangement according to claim 1, wherein:

said base structure contains an independent foundation on the seabed comprising a suction anchor.

4. The arrangement according to claim 1, further comprising a mechanical coupling between the swivel device and the housing for common rotation of said swivel device and said housing.

5. The arrangement according to claim 1, further comprising:

central fluid passages extending axially through a whole length of a core member of the swivel device to the top of the swivel device; and a detachable blocking member for the fluid passages at the top of the swivel device.

6. The arrangement according to claim 1, wherein:

the yoke contains two yoke legs connected to two attachment members; and a lower end of the at least one riser is connected centrally to the swivel device and extends outwards from the swivel device centrally between the two yoke legs.

7. The arrangement according to claim 6, wherein plural risers extend from said swivel device at a more horizontal angular position than the angular position of the yoke legs during substantially all mooring conditions.

8. The arrangement according to claim 6, wherein the connecting member for the umbilical cable is located at an upper part of said swivel device, and wherein the swivel device contains a swivel member for cable connections at the same level as the connecting member for the umbilical cable.

9. The arrangement according to claim 1, wherein said christmas tree contains a detachable connector means for cooperation with the wellhead at its lower portion; and said swivel device contains a cooperating means at its lower portion for retrieving said christmas tree and said swivel device in common or separately.

10. The arrangement according to claim 1, wherein said christmas tree is a simplified christmas tree and substantially comprises only one production master valve and one annulus valve.

11. The arrangement according to claim 10, wherein said connecting members comprise valves adapted to act as wing valves.

* * * * *